US005098663A

United States Patent [19]

Berthold et al.

[11] Patent Number: 5,098,663

[45] Date of Patent: Mar. 24, 1992

[54] SPECIMEN RACK FOR SPECIMEN CONTAINERS

[76] Inventors: Fritz Berthold, Eulerweg 9, D-7530 Pforzheim; Willy Lohr, Ginsterweg 75, D-7547 Wildbad, both of Fed. Rep. of Germany

[21] Appl. No.: 426,300

[22] Filed: Oct. 24, 1989

[30] Foreign Application Priority Data

Oct. 24, 1988 [DE] Fed. Rep. of Germany ... 8813340[U]

[51] Int. Cl.[5] ..... B01L 9/06

[52] U.S. Cl. ..... 422/104; 422/65; 422/99; 435/287; 435/809

[58] Field of Search ..... 422/104, 99, 65; 435/809, 287

[56] References Cited

U.S. PATENT DOCUMENTS

| | | | |
|---|---|---|---|
| 3,713,771 | 1/1973 | Taylor et al. | 422/104 |
| 3,785,773 | 1/1974 | Rohrbaugh | 23/253 R |
| 4,459,265 | 7/1984 | Berglund | 422/64 |
| 4,495,150 | 1/1985 | Cook et al. | 422/104 |
| 4,751,186 | 6/1988 | Baisch et al. | 422/104 |
| 4,895,650 | 1/1990 | Wang | 422/104 |

*Primary Examiner*—Timothy M. McMahon

*Attorney, Agent, or Firm*—Spensley Horn Jubas & Lubitz

[57] ABSTRACT

A specimen rack for specimen containers such as test tubes composed of M structurally identical holders for linearly receiving N specimen containers at a time as well as a stand for receiving the M holders, which stand has vertical side parts, so that a plurality of holders can be mounted on the stand parallel to one another and affixed there by means of a detent connection. With this modularly designed specimen rack, the stand enables secure holding of multiple containers, while contrarily the holders, in which the specimen containers can remain during all the stages of the procedure, may be an inexpensive disposable plastic part the purpose of which is merely the linear, spatial association of a number of specimen containers, and which after the measurement is ended can optionally be discarded along with the specimen containers. Because of the minimal design of such a holder, any disposal problems are also slight. The specimen containers can be inserted into the holders at the outset and remain there, so that tedious shifting operations, which could cause mistakes and mixups, are reliably avoided during the detection process. This is particularly significant in performing immunoassay measurements.

15 Claims, 4 Drawing Sheets

20
21
22
22A
23A
23B
24A
24B
25A
25B
26A
26B
27A
28
29
30
40
40A
40B
40C
40D
40E
41
48
49
X

SPECIMEN RACK FOR SPECIMEN CONTAINERS

BACKGROUND OF THE INVENTION

1. Field of the Invention

The invention relates to a specimen rack for specimen containers, such as test tubes, having M×N openings at its top to receive M×N specimen containers.

2. Prior Art

In the medical field, a great number of detection methods are known for discovering or identifying certain substances, one example being known as immunoassays.

A common feature of all these immunoassays is that to perform them, a more or less large number of method steps is needed to achieve buildup of the aforementioned complex, that includes the label, from the specimen taken from the patient in which the applicable substance is to be detected. This takes place in stages including, among other steps, addition of the labeled antibodies or antigens, elimination of excess substances, and so forth.

As a rule, such measurement techniques are not performed, on a commercial laboratory scale, "individually", that is, by successive processing of a single specimen container; instead, batch quantities of up to a 100 sample containers are typical. The problem consequently arises of how to make a large number of sample containers, as a rule test tubes, proceed quickly and reliably, without any change in their order, through these method steps. Between method steps, the specimen containers must be shifted repeatedly among the various pieces of equipment involved, and finally must be moved into the measuring instrument.

It is accordingly typical for the specimen containers, optionally after suitable pretreatment, used for performing this kind of measurement, which is composed of a plurality of method steps, to be kept in a rack while as many method steps as possible can be carried out. In the simplest case, such a rack comprises a plastic stand having, for instance, a matrix of 5×10 holes on its top, into which the specimen containers are inserted.

To avoid mixing up specimens, each test tube is generally individually written upon. This writing can for instance be done as long as the test tubes are not yet in the specimen rack. Sometimes, however, the specimens are already furnished in racks by the manufacturer, and then they must be individually removed from the rack, written upon, and replaced in the rack. The removal and replacement are labor-intensive.

Another problem is the addition of substances, or in other words the addition by pipette of patient samples, and—in the case of the immunoassay—the addition of the so-called labels, namely the radioactively or non-radioactively labeled antigens or antibodies. If the test tubes have the often-used dimensions of 12 mm in diameter and 75 mm in height, for example, then with conventional pipettes or dispensers it is not possible to pipette material with the required accuracy into the samples that stand vertically in the rack. This is primarily because the bottom of the test tubes cannot be seen during the pipetting, as long as the view is blocked by other specimen containers standing in the rack. The usual procedure is therefore to remove the test tubes individually for the pipetting, holding them obliquely with one hand, and guiding the pipette or dispenser with the other hand and performing the pipetting. After that, each test tube is replaced individually into the rack.

SUMMARY OF THE INVENTION

It is therefore an object of the invention to provide an improved specimen rack offering the maximum possible safety in handling it enabling the entire process sequence to be simplified.

A specimen rack for specimen containers said rack having a top provided with M×N openings for receiving M×N specimen containers, comprising:

M structurally identical holders each constructed for receiving N specimen containers aligned in a row; and a stand for receiving said M holders; wherein each said holder comprises a bracket-like plastic part having a longitudinal axis and provided with N container receiving openings aligned in a row extending along said longitudinal axis for frictionally receiving N specimen containers, said stand comprises two vertical side parts configured to receive said M holders so that said M holders are mounted parallel to one another, and said holders and said stand are configured to form a detent connection for holding said holders in position on said stand.

The basic concept of the invention is accordingly the modular design of the specimen rack by suitably combining two structural components, so that the stand makes it possible to securely hold a plurality of retainers, while contrarily the holder in which the specimen containers remain during all the operations, can be embodied as an inexpensive, "throwaway" plastic part, the purpose of which is merely the linear, spatial association of a number of specimen containers, and which after the measurement is ended can optionally be disposed of along with the specimen containers Because of the minimal structure of such a holder, any disposal problems are also minimized. The specimen containers can be inserted in this holder at the outset and can remain there, thereby reliably avoiding tedious shifting during the detection steps that could cause mistakes and mix-ups.

The aforementioned disadvantages, that is, the possible need for repeated removal and replacement of the test tubes in conventional racks, are avoided by using the holder.

The specimen containers can easily be written upon while they are in the holder; that is, they need not be removed for this purpose.

The same is true for the pipetting. The user can take the holder, for instance containing 10 samples, in one hand and hold it, for instance inclined by an angle of 45° from the vertical, while with the other hand he introduces the pipette and adds liquids, suspensions and so forth, while the entire specimen container and in particular its lower portion remains fully in view throughout, because only one row of specimen container at a time is located in the holder.

After each addition of the reagents, one holder after the other is then inserted into the stand, until once again there is a complete specimen rack, made up modularly of a plurality of holders in one stand. The samples are then introduced, in the thus-assembled sample rack, into an incubator/shaker and/or into a washing station.

The holders are not removed from the stand and inserted into the measuring instrument unless an external measurement should be necessary.

An exemplary embodiment of the specimen rack according to the invention and its handling will be described in detail below, referring to the drawings.

BRIEF DESCRIPTION OF THE DRAWINGS

FIGS. 4A–4M are simplified pictorial illustrations of the sequence of steps in an immunoassay, using the elements of the rack system according to the invention.

DESCRIPTION OF THE PREFERRED EMBODIMENT

Figures 1, 2:
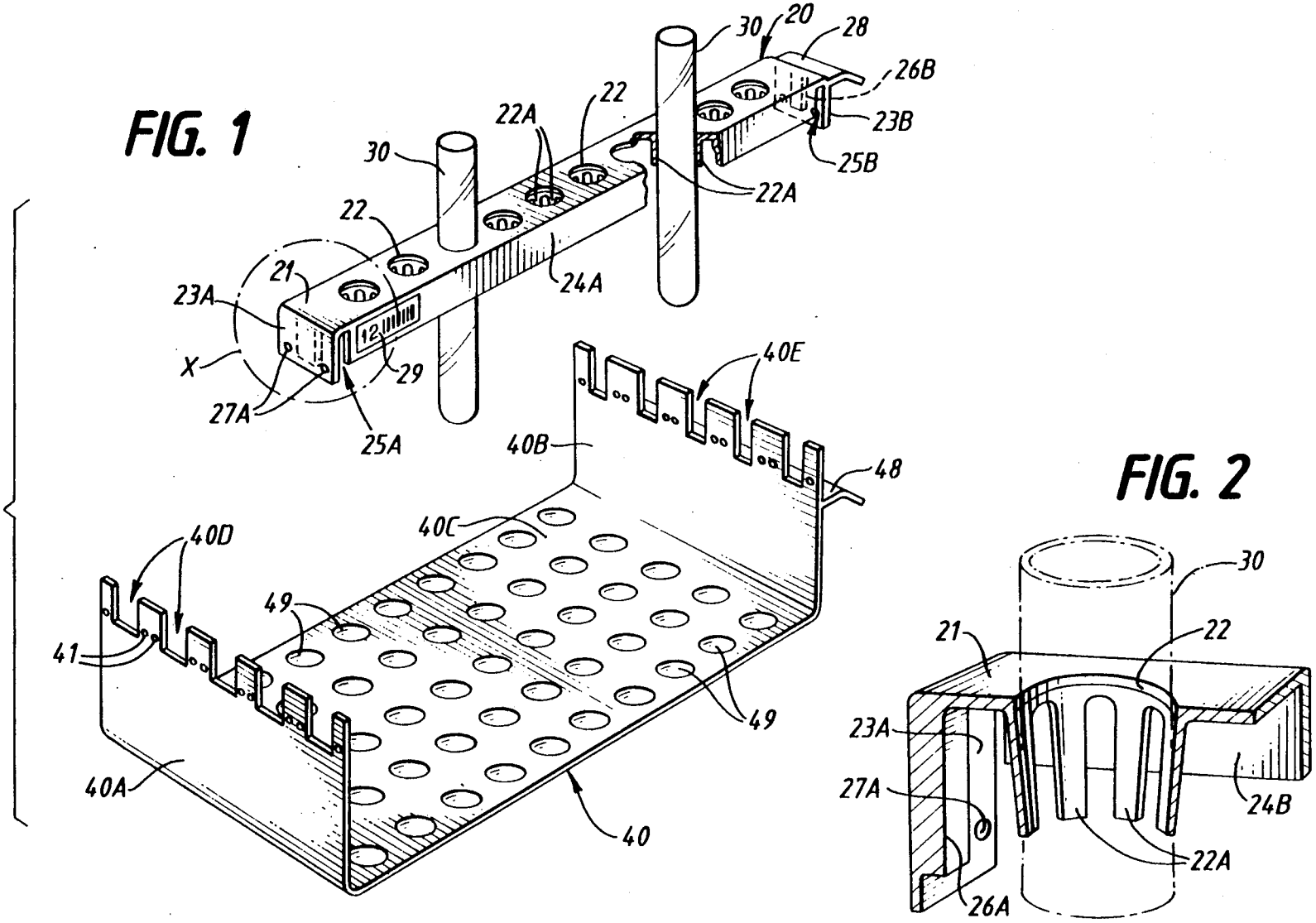
FIG. 1 is an exploded perspective view of the stand of an embodiment of a rack system according to the invention with an associated holder.
FIG. 2 is a detail view, partly in section, of a region designated by X in FIG. 1.
Figure 3:
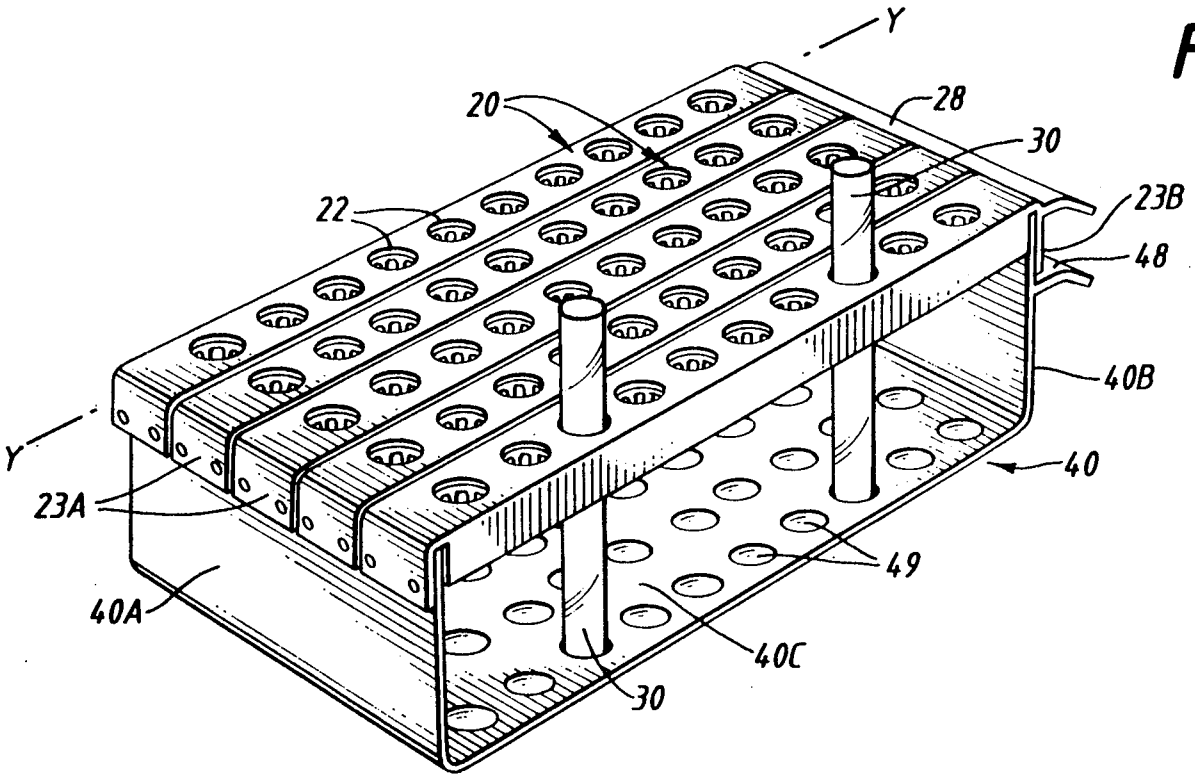
FIG. 3 is a view similar to that of FIG. 1 showing the stand of FIG. 1 with a plurality of holders mounted on it.

FIG. 1 shows two of the three essential components of a rack system according to the present invention: a holder 20 for receiving a plurality of specimen containers 30, and a stand 40 for holding a plurality of such holders 20 parallel to one another (see FIG. 3).

Each holder 20 is made of a plastic part 21 which has longitudinal side faces 24A, 24B extending downward along both long sides, and vertical end faces, or extensions, 23A, 23B bent downwardly at both ends of part 21, so that holder 20 has a somewhat trough-shaped form. In the corner regions of part 21, that is at the transitions between side faces 24A, 24B and vertical extensions 23A, 23B, vertical slits 25A, 25B are provided. A handle strip 28 is also attached to one end face.

The design of the vertical extensions 23A, 23B can be seen in detail particularly in FIG. 2. Each vertical extension 23A, 23B, in the lower portion of its middle region, symmetrically to the longitudinal center axis Y—Y of holder 20 (see FIG. 3), has an inwardly pointing thickened portion 26A, 26B, and on both sides of this thickened portion there are respective indentations, indentations 27A being shown at the lefthand end in FIGS. 1–3 and the corresponding indentations at the right-hand end the holder 20 not being visible in the drawings.

The two vertical extensions 23A, 23B are of equal length, while the thickened portions 26A, 26B extending as far as the lower edge of the extensions are of respectively different widths in the direction between side faces 24A and 24B. Specifically, in the illustrated embodiment, the portions 26B are narrower than the portions 26A.

The stand 40 is in the shape of a U, with a bottom part 40C and two parallel sides parts 40A and 40B. The upper region of stand 40 is especially adapted to holder 20, in order to receive it, as follows:

First, rectangular recesses 40D, 40E are provided on the upper edges of sides parts 40A and 40B, each recess being located between two protrusions, or bosses 41 projecting horizontally by a small distance from parts 40A and 40B. Recesses 40E in the side part 40B are not as wide as the recesses 40D in the left side part 40A.

A horizontal handle strip 48 is attached to the right side part 40B.

The size and shape of recesses 40D, 40E are adapted to the thickened portions 26A, 26B at the interior of holder 20 in such a way that when a holder 20 is placed upon stand 40 the vertical extensions 23A, 23B fit over the side parts 40A, 40B from the outside, and the thickened portions 26A, 26B can then slide into, substantially form-fittingly, an opposed pair of recesses 40D, 40E. At the same time, upwardly projecting regions located at the top of parts 40A and 40B and bordering recesses 40D, 40E nest in slits 25A, 25B. The resulting interfitting relation is particularly clearly seen in FIG. 3. Protrusions 41 then also snap into place in the associated indentations 27A so that a snap-in connection exists between each holder 20 and stand 40.

The aforementioned dissimilar design of the thickened portions 26A and 26B and of the associated recesses 40D and 40E on both sides of the support and holder serve to destroy the symmetry on the holder 20 relative to a central plane parallel to the side parts 40A, 40B of the stand 40, so each holder 20 can be placed absolutely horizontally, i.e., parallel to bottom 40C, upon the stand 40 only in one defined position; conversely, if a mistake is made (for instance if the holder is rotated by 180°), this produces a readily apparent tilted position of the holder 20 on the stand 40, because the (wider) thickened portion 26A on the inside on the left side of a holder 20 cannot be inserted into a (narrower) recess 40E in the right side 40B of the stand 40.

To prevent mistakes from occurring in the first place, the two handle strips 28, 48 are provided on the same side, in the exemplary embodiment on the right side, so that the correct association of the holders 20 in the stand 40 is immediately apparent even without great attention on the part of the user. These provisions accordingly provide double safety against a possible mistaken insertion of holders 20 into the stand 40. Such mistaken placement must absolutely be avoided, because it would cause errors in the order of the specimen containers 30 in the holder 20, and this would have grave consequences both for the outcome of measurement and for the patient involved.

Since, as a function of the particular detection method used and the equipment with which the user works, it may be necessary to remove the holders 20 from the stand 40 and reinsert them a number of times for the various procedures to be performed, this double safety system is of particular significance.

For additional safety and to identify the specimens, a marking strip, for instance a bar code 29, is applied to the side face 24A of the holder 20.

For retaining the specimen containers 30 in the holder 20, the openings 22 on the top of the holder 20 are provided with downwardly oriented elastic plastic tongues 22A, which in the undeformed state, i.e., without a specimen container 30 inserted, point at least slightly inwardly, or in other words are located on the surface of a truncated cone whose axis is perpendicular to the top of plastic part 21. Depending on the outside diameter of the specimen container 30, these elastic plastic tongues 22A are spread apart to a variable extent outwardly upon insertion of a container 30, so that a frictional engagement exists between these tongues 22A and the specimen container 30. Tongues 22A are arranged to make the engagement strong enough that the holder 20 can be transported with specimen containers 30 inserted, without these containers changing their vertical positions in the holder 20.

These plastic tongues 22A also have a centering effect on the specimen containers 30, because they assure a precise vertical alignment of the specimen containers.

To reinforce this centering effect, the bottom 40C has a number of indentations or bores 49, such that when the stand 40 is fully occupied by holders 20 (FIG. 3), one bore 49 comes to rest vertically below each opening 22. The diameter of the bores 49 and their internal wall shape is selected such that the specimen containers undergo a lateral fixation; this can be attained for instance by means of a downwardly tapering cross section of the bores 49, so that specimen containers of various diameter can also be received.

In FIG. 4, the stages of a process typically employed for performing an immunoassay are shown, using the components according to the invention and described in detail above, that is, the holder 20, stand 40 and a support element which is constructed specifically to cooperate with the measuring instrument and which may have the form disclosed in our copending application entitled RACK SYSTEM FOR A PLURALITY OF SPECIMEN CONTAINERS FOR PERFORMING RADIOASSAYS U.S. Ser. No. 07/426,280.

Figure 4B:
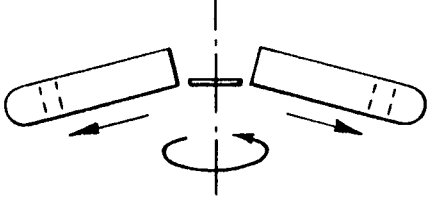
Figure 4C:
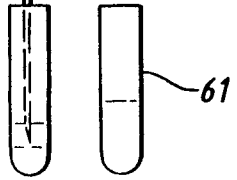
Figure 4A:
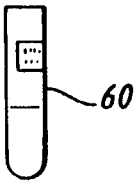

FIG. 4A shows a test tube 60 holding a blood sample which was, for instance, drawn from a patient and containing a substance of interest which is to be detected. In a centrifuging station, the serum used for the measurement and containing the substance to be analyzed, is separated from the blood corpuscles, as shown in FIG. 4B. The serum is removed and a serum sample is usually temporarily stored in the form of a primary sample in a tube 61, as shown in FIG. 4C, for distribution to a plurality of specimen containers for various tests.

Figure 4E:
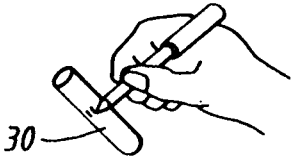
Figure 4F:
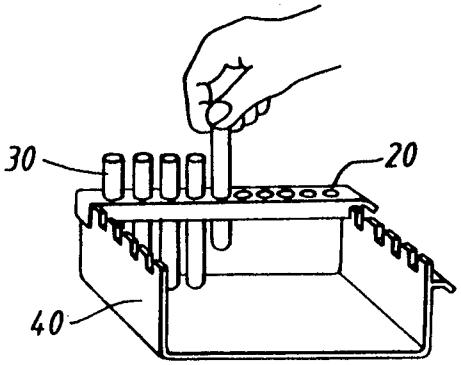
Figure 4D:
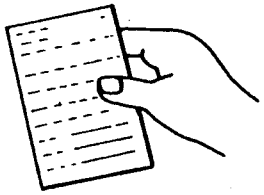

The relevant data such as the name of the patient, type of test, etc., are recorded on a data carrier, depicted in FIG. 4D.

To perform the immunoassay, commercially available specimen containers 30, which may be test tubes, are used and, as shown in FIG. 4E, are provided with a brief identification to match the documentation of FIG. 4D. For certain immunoassays, the specimen containers 30 used here may already be provided with an antibody coating on the inside that is specific for the substance to be analyzed or detected.

As shown in FIG. 4F, the specimen containers 30, suitably prepared and labeled, are then introduced in succession into the holders 20 mounted on a stand 40 and thrust as far as the bottom of the stand 40, where their bottoms plunge into the bores 49 of the bottom 40. Alternatively, a group of specimen containers 30 may already be placed in the holders 20 by the manufacturer of the diagnostic kits. In that case, containers 30 can be written upon very easily, without having to be removed from the holders 20 or replaced therein again after being written upon.

Figure 4G:
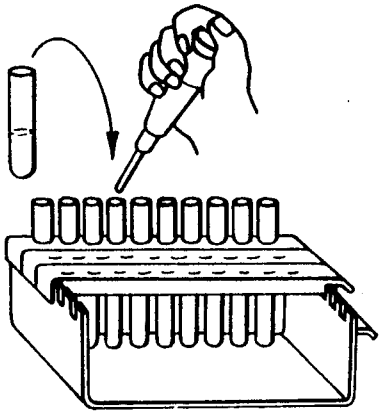
Figure 4H:
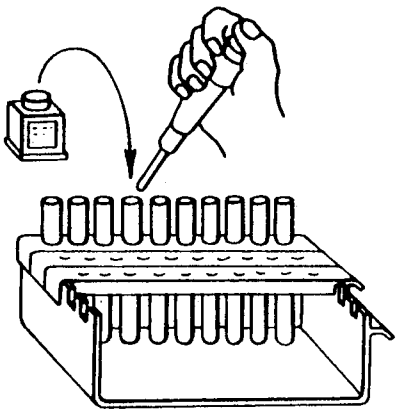

Next, referring to FIG. 4G, the serum in tube 61, taken from the primary sample and containing the substance to be analyzed, is transferred into one of the specimen containers 30, and then the next patient sample is transferred to the next container 30, and so forth, until all of containers 30 for instance contain patient samples. Then the reagents, or in the case of the immunoassay the labeled antibodies or antigens, are introduced with a pipette, as depicted in FIG. 4H. This can either be done while the samples are in stand 40 or one holder after another is removed for adding the reagent and then replaced in stand 40 again.

Figure 4I:
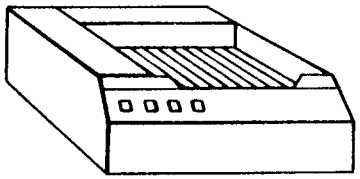

Next the stand 40, suitably equipped with holders, is introduced into an incubator, shown in FIG. 4I, in which the desired antigen-antibody reaction takes place, optionally at an elevated temperature. To this end it may be necessary, to accelerate the process, to subject stand 40 with the holders 20 to a shaking action.

Since if the immunoassay is to proceed properly, excess ingredients in the substances involved must be removed, the stands with the holders are subsequently inserted into a washing apparatus, shown in FIG. 4K. If such equipment is not available in the laboratory, then the specimen containers 30 can be filled with cleaning reagent, and the entire sample rack (stands plus tubes) is decanted. Under some circumstances this part of the procedure may have to be performed several times.

Figure 4L:
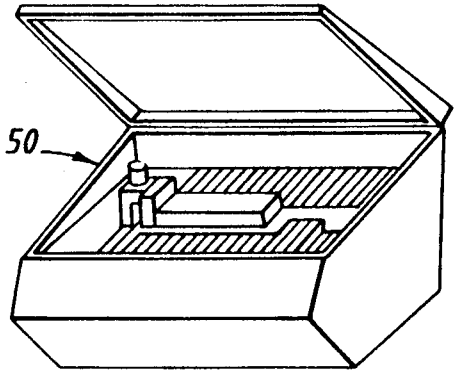

The specimen containers, thus prepared, are then inserted one holder 20 at a time into a support element traveling over a closed path in the actual measuring instrument 50, shown in FIG. 4L, and are then moved past the measuring site, where the substances that initiate the chemiluminescence are added and the resultant light yield is measured, the intensity of which is a standard for the quantity of the substance to be detected in the substance to be analyzed.

Figure 4M:
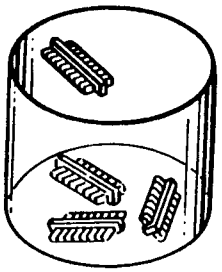
Figure 4K:
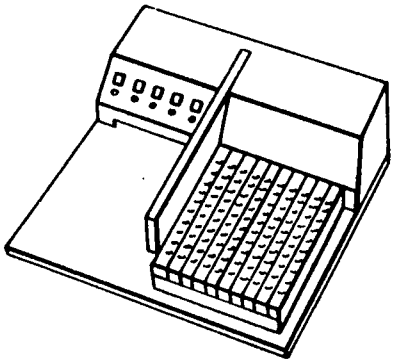

After that, the holders, with the specimen containers that have been measured, are removed once again from the associated support element and discarded, as indicated in FIG. 4M.

A special feature of this last step is that in contrast to the previously known methods, the holders 20 can be discarded along with the specimen containers; this represents a major simplification and saves additional steps in the process.

Another significant aspect is that because the specimen containers 30 are firmly retained in the stand 40, secure handling of all containers 30 together becomes possible, for instance while shaking or decanting them, without having to remove individual specimen containers 30 or holders 20.

It is particularly advantageous if the specimen containers 30 are test tubes, for instance with a coating, which are already sold in holders by the diagnostic kit manufacturers, because in that case they can remain in the holders all the way through the process, from the specimen preparation, through the measurement, until they are disposed of.

In immunoassays it is also conventional to bind antigens or antibodies to magnetic (typically paramagnetic) particles that are in suspension. To separate bound and free reagents, external magnets are used to attract the particles in suspension to the inside of the specimen containers, and in this state the fluid with the non-bound reagents can be removed from the test tubes by aspiration or decanting, while the magnetic particles remain in the tubes.

The concept according to the invention of the modular rack, comprising holders 20 and one or more stands 40, can also be advantageously used when magnetic particles are used. It need merely be provided that, for accomplishing the separation and in the actual separating step itself, the specimen containers must be located within the sphere of influence of magnetic fields, while otherwise, for instance during incubation phases, the magnetic field should not have an influence. The stand 40 can therefore be embodied in a known manner in such a way, or with an open bottom surface, that it can be placed on an undercarriage that contains magnets, which after the modular rack is mounted in place exert the magnetic field needed for the separation upon the magnetic particles located in the suspension. The magnets, generally permanent magnets, are disposed in such a way that they attract the magnetic particles either toward the bottom or, in the lower region, to the sides of the specimen containers.

For decanting, the combination of the holders, stand and undercarriage is then tipped over as a unit.

After that the combination of holders and stand can be disconnected from the undercarriage again, and washing fluid, for instance, may be added. The holder and stand combination can then be mounted on the undercarriage again; a period during which the magnetic particles deposit on the wall can be waited out, and then decanting can be performed again.

This application relates to subject matter disclosed in Federal Republic of Germany Application G 88 13 340.0, filed on Oct. 24, 1989, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A specimen rack for specimen containers said rack having a top provided with M×N openings for receiving M×N specimen containers, comprising:

M structurally identical holders each constructed for receiving N specimen containers aligned in a row; and a stand for receiving said M holders; wherein each said holder comprises a bracket-like plastic part having a longitudinal axis and provided with N container receiving openings aligned in a row extending along said longitudinal axis for frictionally receiving N specimen containers, said stand comprises two vertical side parts configured to receive said M holders so that said M holders are mounted parallel to one another, and said holders and said stand are configured to form a detent connection for holding said holders in position on said stand, said plastic part has two end faces which are spaced apart in the direction of said longitudinal axis and which constitute two vertical extensions each perpendicular to said longitudinal axis and each located at a respective one of said end faces, said plastic part has a top surface extending parallel to said longitudinal axis and two longitudinal side faces extending between said end faces and perpendicular to said top surface, said plastic part is provided with vertical slits formed between said vertical extensions and said side faces, each vertical extension has two lateral edges extending perpendicular to said longitudinal axis and a lower edge remote from said top surface, each vertical extension has a thickened portion at the side of said vertical extension which faces the other end face of said plastic part, in the vicinity of said lower edge and spaced inwardly of said lateral edges, said stand further comprises a horizontal base part extending between said side parts to give said stand a U-shaped cross section, each said side part has a top edge which is remote from said base part and which is provided with a plurality of recesses, the spacing between, and cross section of, and said recesses are dimensioned such that said M holders can be placed parallel to one another upon said stand with said thickened portions engaging in said recesses, said vertical extensions fitting over, and disposed outside of, said side parts, and portions of said side parts bordering said recesses seated in said slits.

2. The specimen rack of claim 1 wherein each said container receiving opening is provided with downwardly pointing elastic plastic tongues which coincide with a conical surface when no specimen container is disposed therein, the conical surface having an axis which is perpendicular to said top surface, and said tongues being located to be spread apart upon the introduction of a specimen container in a respective container receiving opening.

3. The specimen rack of claim 1 wherein said plastic part of each said holder has a U-shaped cross section in the plane at right angles to said longitudinal axis.

4. The specimen rack of claim 1 wherein said top surface and said side faces form a U-shaped cross section in the plane at right angles to said longitudinal axis.

5. The specimen rack of claim 1 wherein each said vertical extension is provided with two indentations at the side of said vertical extension which faces away from the other end face of said plastic part, each said indentation being disposed adjacent a respective one of said two lateral edges of said vertical extension, said indentations forming part of said detent connection.

6. The specimen rack of claim 1 further comprising an identification element applied to one of said side faces of each said plastic part.

7. The specimen rack of claim 6 wherein said identification element is a bar code strip.

8. The specimen rack of claim 1 wherein:

said top surface and said side faces form a U-shaped cross section in the plane at right angles to said longitudinal axis, and said recesses have a rectangular cross section.

9. The specimen rack of claim 8 wherein:

each said vertical extension is provided with two indentations at the side of said vertical extension which faces away from the other end face of said plastic part, each said indentation being disposed adjacent a respective one of said two lateral edges of said vertical extension; and each said side part is provided with outwardly directed protrusions adjacent each side of each said recess in correspondence with said indentations in said vertical extensions of said plastic part for establishing said detent connection between said holder and said stand.

10. The specimen rack of claim 8 wherein said stand has a handle strip on at least one said side part.

11. The specimen rack of claim 8 wherein said thickened portions of said vertical extensions and said recesses in said side parts are formed asymmetrically with respect to a median plane midway between, and parallel to, said side parts to an extent such that a parallel positioning of each said holder with respect to said base part of said stand is possible only for one defined position of said holder relative to said stand.

12. The specimen rack of claim 11 wherein said thickened portions of said vertical extensions and the associated recesses in said side parts of said stand correspond to one another in pairs.

13. The specimen rack of claim 8 wherein said base part of said stand has a plurality of bores located to each be under a respective container receiving opening of each said holder when said holder is mounted on said stand.

14. The specimen rack of claim 13 wherein each of said bores tapers downwardly.

15. The specimen rack of claim 1 wherein each said holder has a handle strip on at least one side.

* * * * *